US006932170B2

(12) United States Patent
Luth

(10) Patent No.: US 6,932,170 B2
(45) Date of Patent: Aug. 23, 2005

(54) DRILLING HEAD

(76) Inventor: Ute Petra Luth, Im Wingert 42, 63667 Nidda (DE)

( * ) Notice: Subject to any disclaimer, the term of this patent is extended or adjusted under 35 U.S.C. 154(b) by 38 days.

(21) Appl. No.: 10/432,311

(22) PCT Filed: Nov. 22, 2001

(86) PCT No.: PCT/EP01/13612

§ 371 (c)(1),
(2), (4) Date: Dec. 5, 2003

(87) PCT Pub. No.: WO02/42014

PCT Pub. Date: May 30, 2002

(65) Prior Publication Data

US 2004/0084221 A1 May 6, 2004

(30) Foreign Application Priority Data

Nov. 22, 2000 (DE) ..... 100 57 877

(51) Int. Cl.[7] ..... E21B 10/26
(52) U.S. Cl. ..... 175/327; 175/385; 175/397
(58) Field of Search ..... 175/327, 421, 175/397, 385, 388

(56) References Cited

U.S. PATENT DOCUMENTS 616,118 A * 12/1898 Kuhne ..... 175/327
946,060 A * 1/1910 Looker ..... 175/385
1,116,154 A * 11/1914 Stowers ..... 175/323
1,296,078 A 3/1919 Hawkesworth
1,387,733 A * 8/1921 Midgett ..... 175/385
1,746,423 A * 2/1930 Hartman ..... 175/385
3,557,887 A * 1/1971 Watson ..... 175/421
4,570,723 A 2/1986 Kostylev et al. ..... 173/116

FOREIGN PATENT DOCUMENTS

| | | |
|---|---|---|
| DE | 16334487 | 10/1970 |
| DE | 2806725 | 8/1979 |
| DE | 4318759 | 12/1994 |
| DE | 89038 | 3/1995 |
| FR | 357403 | 12/1905 |
| NL | 06804149 | 9/1969 |
| WO | 9846374 | 10/1998 |

* cited by examiner

*Primary Examiner*—Hoang Dang
(74) *Attorney, Agent, or Firm*—Howard & Howard

(57) ABSTRACT

A drilling head (1) is disclosed, in particular for introduction into pipelines, with a rear connector piece (2) and a forward cutting body (3) of the size of the diameter, comprising cutting ribs (4), extending in the advancing direction (V), which have a convex arch and have a cutting edge (5) on both sides of the radial end thereof in the direction of the circumference. Conventional drilling heads can be applied only with difficulty in curved pipelines and have a tendency to damage the inner wall of the pipeline. The disclosed drilling head (1) has a cutting body (3) with a conical cutting head tip (7), surrounded by the back-cut tips (6) of the cutting ribs (4) which lie set back along a longitudinal axis (Y).

13 Claims, 1 Drawing Sheet

DRILLING HEAD

BACKGROUND OF THE INVENTION

1. Technical Field

Figure 1:
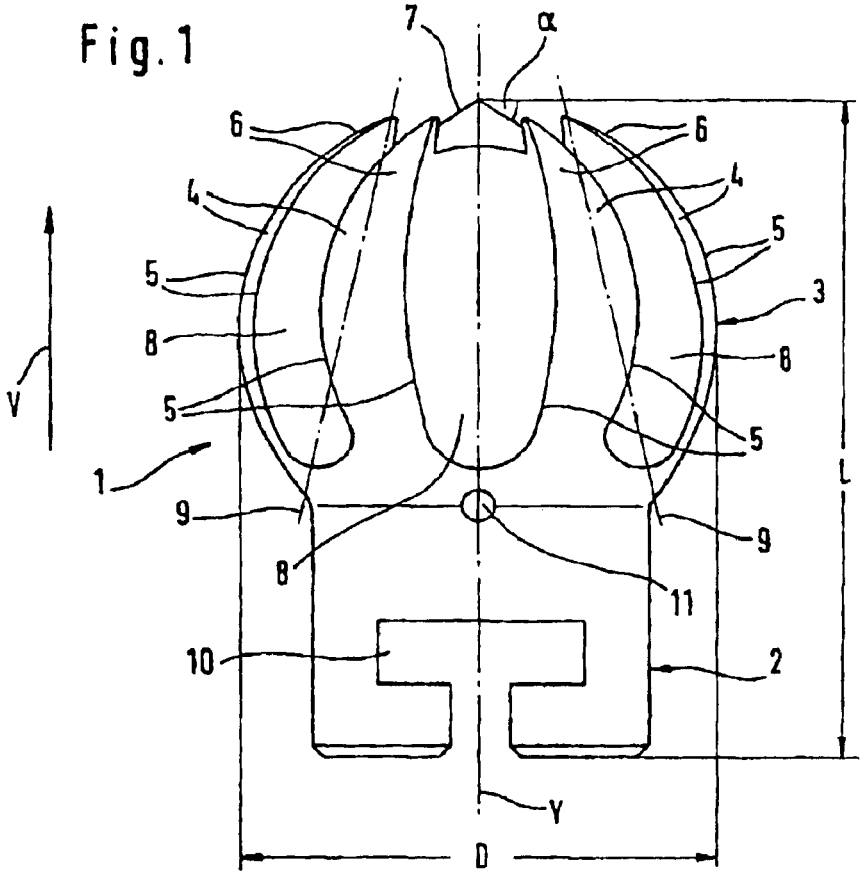

The invention deals with a drill head, especially for introduction into pipes, with a rear attachment piece and a front cutting body of larger diameter, which has cutting ridges extending in the drive direction, where the cutting ridges are convex curved and have a cutting edge on both sides in the circumferential direction at their radial end.

2. Related Art

Drill heads of this type are used, for example, to bore out deposits in pipes. To this end, the drill heads are rotated by means of a spiral, a shaft, or alternatively a flush-driven drill motor, and moved in the axial direction.

SUMMARY OF THE INVENTION

One drill head of this type is known from DE 28068725 C2. The known drill head has cross slits in the base body of the cutting body, in each of which two drill blades with wings are set. The long shape has a disadvantage in that it allows only limited curve access. In addition, the drill head has only slight guidance via the edges of the four drill blades that run parallel to the drive direction, so that for strong encrustations, the drill head can be jammed, and for high drive forces, the inner wall of the pipe can be damaged.

DE-PS 940460 publishes a process and a device for cleaning straight pipe segments of water pipes with a scraper mounted on a stiff pole, which is introduced into the pipe and constantly pushed forward under rotation with counter-flowing water. Because of the stiff pole, the known scraper cannot go through curves. Also disadvantageous is the low guidance of the scraper head via a scraper blade, which extends on both sides past the extent of the scraper head and constantly touches the pipe wall at two contact points.

A further state of the art is shown in FR 2 303 650 A1, in which a spiral drill with a spherical head and a shaft is described, where the spherical head has cutting edges as well as a centering point. The protected spiral drill has, however, the disadvantage of a lengthy, inflexible shape, so that use in bent pipes is not possible without damaging the pipe.

The newest state of the art is published in U.S. Pat. No. 1,296,978 A, in which a chisel for hard stone with a changeable blade and an attachment piece on a drill bar is claimed. In this case the rear attachment piece includes a tongue-shaped slot and the changeable blade has a complementary extension, where the slot and the extension extend in the direction of the longitudinal axis of the chisel, and are tapered. This allows, when drilling, the blade to be pressed in the direction of the taper and thereby fixed. To remove the blade, for instance, a hammer can be struck on the blade in the direction opposite the taper, so that the blade is loosened and can be changed.

In FIGS. 1 through 7 of the previously named document, a drill head is shown that also has a rear attachment piece and a frontal cutting body of larger diameter, as is best seen in FIG. 7.

The cutting body has cutting ridges that extend in the drive direction and that, although only slightly, are convex in shape. In addition, a rear cutting of the cutting edges at their radial end is published. The previously described drill head is, however, also not suitable for preserving the pipes, especially bent pipes, while cleaning.

It is, therefore, the task of this invention to present a drill head that allows optimized cutting progress with the least damaging processing of the inner pipe wall, including those of bent pipes.

This task is solved with a drill head on which the cutting body has a conical drill head point, which is surrounded by undercut points of the cutting ridges that are set back in the longitudinal Y direction. Because of the convex rounded cutting ridges, the pipe wall is significantly less loaded than with existing systems, since the drill head can position itself under increased drive forces, such as would be caused by curvature in the pipe and/or deposits that reduce the pipe diameter. With a swinging head motion fixed by the conical drill head point, the drill head moves in the drive direction. Increased surface pressure due to cocking of the drill head on the inner pipe wall is thereby avoided. The cutting edges located on both sides of the cutting ridges allow effective application regardless of the direction of rotation. The undercut of the cutting edges allows removal of even hard deposits, since the deposits are loaded in extension. The strength in extension, particularly of mineral deposits, is a fraction of the strength in compression or shear.

Base on the previously described design of the drill head, the drill head begins to turn to one side under increasing drive force, whereby the points of the cutting ridges come into contact with the deposits and remove them. In addition, due to the conical shape of the drill head point, the undercut points of the cutting ridges cut in an inverted direction and thereby reduce the risk of damage to the pipe.

Advantageously, the drill head has cutting ridges that taper to a point in the drive direction.

In a preferred version, the cutting body has a conical drill head point. The conical drill head point can extend past the points of the cutting ridges. This has the advantage that the drill head is fixed by the conical drill head point when it contacts a deposit. A favorable geometry of the conical drill head point is achieved with an angle of 40–50°, especially of 45°.

Advantageously, the cutting ridges are arranged equidistantly in the circumferential direction. This achieves smooth running, even at high RPM.

In a favorable design shape, a round cross-section cavity is provided between the cutting ridges. This cross-sectional geometry allows the possibility of providing the cutting edges with an undercut.

In a preferred design shape, the attachment piece and the cutting body are made of one piece. The solid design shape of the drill head reduces vibration in the cutting ridges and increases the wear life.

In an advantageous design shape, the cavity is milled in the cutting body. This allows cost-effective mechanical mass production with low production tolerances.

Advantageously, the axes of the cavities meet in an intersection before the drill head. The angled orientation of the axes of the cavities ensure favorable removal of drill chips, whereby the drill progress is increased and the wear on the drill head is reduced.

In a favorable design shape, the total length L of the drill head, in relation to the outer diameter D, is $\leqq 1.2$. The compact design with an outer diameter approaching the length of the drill head improves the curve access of the drill head.

A preferred design shape has a T-shaped slot in the cylindrical attachment piece, in the longitudinal axis of the drill head. In addition, two holes can be drilled in the radial direction at the transition from the cylindrical attachment piece to the cutting body. These features serve to mount the drill head on a spiral, a shaft, or a flush-driven drill motor.

THE DRAWINGS

Figure 2:
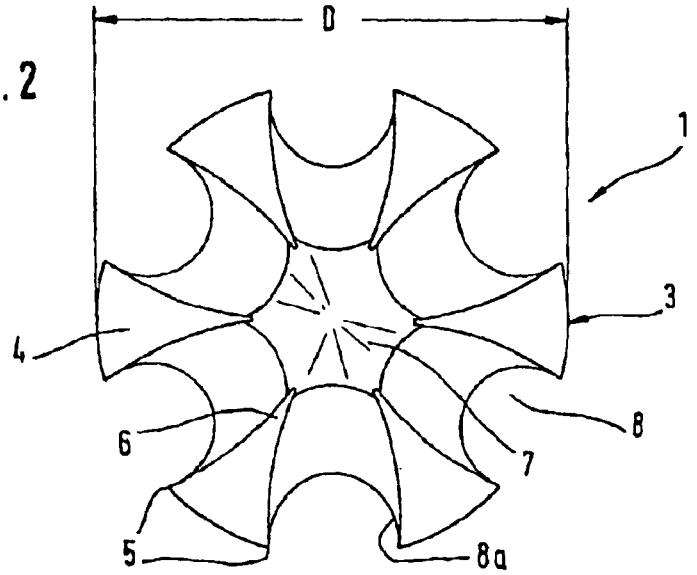

Using a design example, the invention is to be more closely described. Shown are:

FIG. 1 A side view of the drill head;

FIG. 2 A plan view of the drill head shown in FIG. 1, against the drive direction.

DETAILED DESCRIPTION

In FIG. 1, the drill head is shown in the side view. The drill head 1 consists of the attachment piece 2 and the cutting body 3.

In the attachment piece 2 is a slot 10 for mounting the drill head 1 to a spiral, shaft, or drill motor (not shown). The mounted drill head 1 can then be secured using a pin (not shown) inserted through the hole 11.

The attachment piece 2 transitions as one piece into the cutting body 3, which has a total of six cutting ridges 4, between which cavities 8 are located. The cavities 8 have a round cross sectional shape. Because of the round cross section of the cavities 8, an undercut 8*a* occurs in the radial area of the cutting ridges 4. The axes 9 of the cavities 8 converge in the direction of the drill head points 7, and intersect in the drive direction V before the point, at a point that is not shown.

The cutting ridges 4 have a convex shape and give the cutting body 3 a spherical shape. Other than the spherical form, oval forms are also possible, and this is determined by the curvature of the cutting ridges 4. Altogether the drill head has a larger diameter than the attachment piece, due to the convex design of the cutting ridges.

Each cutting ridge 4 extends in the longitudinal direction of the drill head 1, that is, in the drive direction, and tapers in the direction of the attachment pieces 2 as well as in the direction of the drill head point 7.

The drill head point 7 is surrounded by the points 6 of the extending cutting ridges 4, which are set back in the longitudinal direction Y, to form a crown. In FIG. 1, the undercut points 6 under the angle α, which allow inverted cutting by the drill head 1, can be seen.

Location, shape, and design of the cutting edge 5 and the cavities 8 allow protection of the inner pipe walls while cleaning, where the removed material is drawn away behind by the cavities 8.

In FIG. 2, the drill head 1 is shown in the plan view, so that the round cross section of the cavities 8 and the undercuts 8*a* of cutting edges 5 can be seen.

List of Drawing Features

1 Drill Head
2 Attachment Piece
3 Cutting Body
4 Cutting Ridges
5 Cutting Edge
6 Point
7 Drill Head Point
8 Cavity
8*a* Undercut
9 Axes of cavity
10 Slot
11 Hole
D Outer Diameter
L Overall Length
V Drive Direction
Y Longitudinal Axis
α Angle

What is claimed is:

1. Drill head for introduction into pipes, having a rear attachment piece and a frontal cutting body of greater diameter, which is made of cutting ridges that extend in the drive direction where the cutting ridges are convex curved and have a cutting edge on both sides of their radial end in the circumferential direction, and wherein the cutting body has a conical drill head point, which is surrounded by the undercut points of the cutting ridges set back in the longitudinal direction.

2. Drill head as in claim 1, wherein the cutting edge has an undercut.

3. Drill head as in claim 1, wherein the cutting ridges converge to a point in the drive direction.

4. Drill head as in claim 2, wherein the conical drill head point extends past the points of the cutting ridges.

5. Drill head as in claim 2, wherein the conical drill head point has an angle (α) of 40°–50°.

6. Drill head as in claim 1, wherein the cutting ridges are arranged equidistant to one another in the circumferential direction.

7. Drill head as in claim 1, wherein a cavity with a round cross section is located between two adjacent cutting ridges.

8. Drill head as in claim 1, wherein the attachment piece and the cutting body are made of one piece.

9. Drill head as in claim 7, wherein the cavity is milled.

10. Drill head as in claim 7, wherein axes of the cavities intersect at a point before the drill head.

11. Drill head as in claim 1, wherein the overall length of the drill head is designed in a ratio of ≦1.2 to the outer diameter.

12. Drill head as in claim 1, wherein a T-shaped slot is made in the attachment piece in the longitudinal axis of the drill head.

13. Drill head as in claim 1, wherein two holes are made in the radial direction at the transition from the attachment piece to the cutting body.

* * * * *